United States Patent [19]

Stahlecker

[11] Patent Number: 4,539,806

[45] Date of Patent: Sep. 10, 1985

[54] FIBER FEED ARRANGEMENT

[75] Inventor: Fritz Stahlecker, Josef-Neidhart Strasse 18, 7347 Bad Überkingen, Fed. Rep. of Germany

[73] Assignees: Hans Stahlecker; Fritz Stahlecker, both of Fed. Rep. of Germany

[21] Appl. No.: 622,453

[22] Filed: Jun. 20, 1984

[30] Foreign Application Priority Data

Jun. 22, 1983 [DE] Fed. Rep. of Germany ..... 3322394

[51] Int. Cl.[3] ..... D01H 7/892; D01H 7/898

[52] U.S. Cl. ..... 57/400

[58] Field of Search ..... 57/400, 401, 408, 409, 57/411, 412, 413, 90

[56] References Cited

U.S. PATENT DOCUMENTS 3,972,173 8/1976 Fehrer ..... 57/401

4,130,983 12/1978 Dammann et al. ..... 57/401 X 4,467,597 8/1984 Parker et al. ..... 57/401

*Primary Examiner*—Donald Watkins

*Attorney, Agent, or Firm*—Barnes & Thornburg

[57] ABSTRACT

An arrangement for open-end friction spinning is disclosed having two adjacently arranged friction rollers driven in the same rotational direction forming a yarn forming wedge shaped gap or slot. A fiber opening device is provided for opening fibers to be spun and a fiber feed channel guides the fibers from the opening device to the yarn forming gap. A yarn withdrawal device is provided for drawing off the produced yarn in the direction of the longitudinal extension of the yarn forming gap. The opening device is configured to simultaneously treat a plurality of fiber bands and the fiber feed channel is divided into several sections in its cross section. The mouths of the feed channel sections are disposed to open to the yarn forming gap at least partially one behind the other along the longitudinal extension of the yarn forming gap.

18 Claims, 7 Drawing Figures

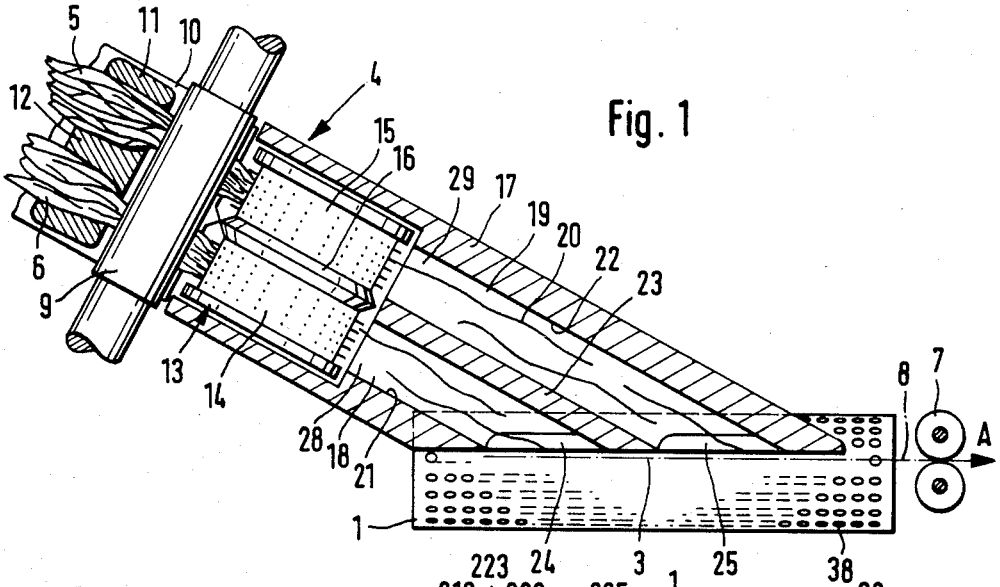
Fig. 1
Fig. 2
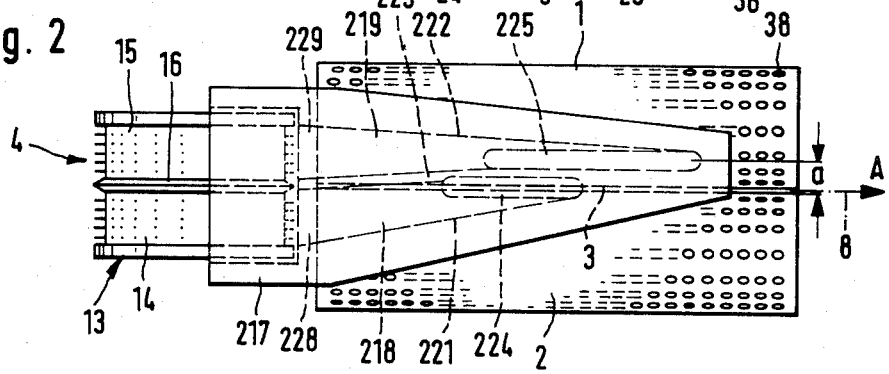
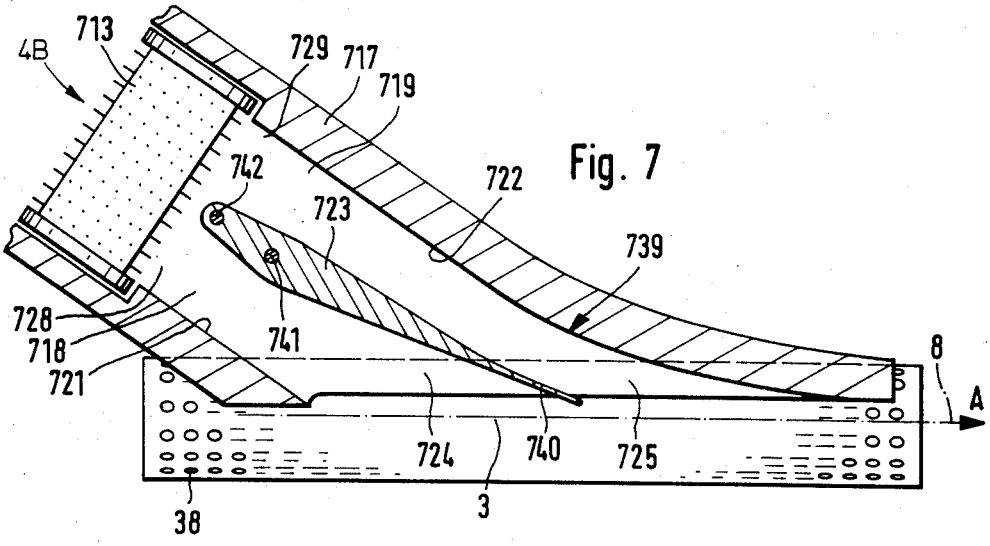
Fig. 7

FIBER FEED ARRANGEMENT

BACKGROUND AND SUMMARY OF THE INVENTION

The invention relates to an apparatus for open end friction spinning with two adjacently arranged friction rollers driven in the same rotational direction forming a yarn forming wedge shaped gap. A fiber opening device is provided for opening fibers to be spun and a fiber feed channel leads from the opening device to the yarn forming gap. A yarn withdrawal device is also provided for drawing off the produced yarn in the direction of the longitudinal extension of the wedge shaped yarn forming gap.

Apparatus of the above-mentioned type is described in German Published Unexamined Application (DE-OS) 28 10 184 whereby high delivery speeds for the produced yarn are desired making it necessary to supply a great amount of fiber material to the wedge-shaped gap. However, there are limits to the increasing of the supply of fiber material by increasing the supply speed and dependent thereupon the rotational speed of the opening device opening roller since a careful handling of the fibers is still necessary if the desired good opening of fiber material to single fibers is to be maintained.

It has been contemplated to simultaneously feed and open several fiber bands for an increase in the amount of fibers to be fed in. With such arrangements, the supply of fibers from the opening device to the yarn forming gap does not occur by means of channels but to a great extent in a free flight. With such arrangements, only a very rough yarn can be spun because the fibers uncontrollably reach the yarn forming gap and are deposited there in an uncontrollable manner.

It is an object of the present invention to so design an arrangement of the above-mentioned type that a greater amount of fiber material is supplied without damage to the fiber material whereby the deposition of the fibers in the yarn forming gap itself occurs in a controlled manner.

This object is achieved in accordance with the present invention in that the opening device is so arranged to allow a simultaneous opening of several fiber bands and in that the fiber feed channel is divided in its cross-section in several sections, the mouths of the feed channel sections being disposed to open to the yarn forming gap at least partially one behind the other along the longitudinal extension of the yarn forming gap.

With the arrangement of the invention, the fibers are guided in a controllable manner from the opening roller to the yarn forming gap and are deposited via several feed channel section areas which are distributed along the length of the yarn forming gap. It is thereby obtained that without an increase of the operational speed of the opening device, not only a greater amount of fiber material is supplied, but also a so-called return doubling occurs, displaying a greater uniformity of the yarn to be produced since the supplied fibers are deposited at several areas. Thereby a further improvement in the uniformity of the yarn to be produced is obtained. If one would utilize a fiber feed channel with a completely free and undivided cross-section rather than the present invention, a fiber feed air stream and associated fiber stream would result with a majority of the supplied fibers being transferred to a preferred position at the yarn forming gap or the associated inwardly turning roller surfaces. An excessive amount of fibers would then exist in this area making the spinning of a uniform and qualitative good yarn impossible.

In a preferred embodiment of the invention, the opening device includes an opening roller the actual length of which is chosen to allow at least two fiber bands to be adjacently supplied thereto, wherein a respective portion or section of the fiber feed channel is disposed to accommodate fibers from each fiber band beginning at the opening roller. These fiber feed channel sections thereby form a separate guide or channel for each fiber band, which channel sections are so-designed especially in the area of the feed channel mouth that the fibers to be transported there are optimally deposited. By using only one opening roller, the additional expenditures necessary for accommodating the increased fiber amount to be supplied is minimized.

In a further embodiment of the invention, the opening device includes an inlet roller and joint feed table designed for supplying several adjacently arranged fiber bands to the opening roller. This kind of inlet and opening device is not much different in principle from the known inlet and opening devices with open-end rotor spinning machines with the exception of a greater axial extension, whereby the manufacturing costs are not essentially greater than for such arrangements.

Another embodiment of the invention is provided, wherein the opening device includes an inlet roller for several adjacently arranged fiber bands, including a single separate feed table for each fiber band respectively. By using single feed tables, an optimal control of the supplying and the opening of each fiber band is obtained and fiber bands of different fiber materials can be supplied and opened. The installation of single-feed tables accommodates individual adjustment of the pressure applied against the joint inlet roller. In the event that different inlet speeds are desired for individual fiber bands it is also contemplated to divide the inlet roller into multiple inlet rollers and/or to provide an inlet roller with stepped different diameters for different fiber bands.

In yet another embodiment of the invention it is provided that the fiber feed channel exhibits a rectangular cross-section at least in its end area facing the opening roller, extending with its greater length parallel to the axle or axis of the opening roller. The fiber feed channel is thus thereby configured to conform to the widened opening roller.

In another embodiment of the invention it is provided that the fiber feed channel is divided into sections by means of at least one partitioning wall starting in a radial plane to the opening roller. The relatively large fiber feed channel is thereby divided into several small channels by a simple means so that the air stream and thereby the fiber transport is well controlled. The partitioning walls in a favorable manner do not begin directly at the opening roller, but at a certain distance so that the entire work area of the opening roller is utilized. It is further advantageous if the partitioning wall or the partitioning walls extend only a portion of the cross-section of the channel. Thereby the airstream and further the fiber stream is favorably influenced whereby fibers cannot get stuck along the outer edges of the partitioning walls.

In yet another embodiment of the invention it is provided that the partitioning wall or the partitioning walls taper knife blade like to a decreasing size in the fiber transport direction in the area of the feed channel section mouths. The mouth areas of the individual sections thus merge together uniformly to a great extent.

A yet further embodiment of the invention is provided wherein the mouths of the feed channel sections are laterally arranged adjacent each other to the yarn forming cap whereby one section mouth is positioned approximately above the yarn forming gap while the other section mouth or mouths are arranged opposite the cover surface of the roller rotating into the yarn forming gap. The arrival of fibers through the section mouths that are positioned at a distance to the yarn forming gap are exposed to a minor lateral motion before they reach the yarn forming gap. A certain effect is thus obtained with the tying up of these fibers.

In yet a further embodiment of the invention it is provided that the partitioning walls are adjustably arranged in position within the fiber feed channel. It is also contemplated to adjust the partitioning wall to a favorable position for a respective fiber material.

In a further embodiment of the invention it is provided that the fiber feed channel is arranged at a sharp angle to the yarn forming gap. Thereby the feed channel section mouths extend with a relatively large portion in the direction of the yarn forming gap so that a good fiber distribution is obtained over the entire yarn formation area.

In another embodiment of the invention the opening roller is divided into respective zones for each fiber band. It is thereby contemplated to provide the opening roller with a ring band between said zones. It is advantageous if the opening roller includes zones which are arranged with different mountings (settings) when supplying fiber bands of different materials, according to certain preferred embodiments of the invention. This for example, would permit supplying fiber bands of different materials with fibers that are responsible for the tenacity of the yarn to be produced being supplied first so that the same reach the center of the yarn to be produced while fibers that are merely designed for the appearance of the yarn are supplied later, thereby forming essentially the cover of the yarn.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 1 is a partial schematic cross-sectional view of a fiber opening and feeding arrangement for open end friction spinning taken along the plane of a wedge shaped yarn forming gap formed by two friction rollers, constructed according to a preferred embodiment of the present invention;

FIG. 2 is a top view from above into the yarn forming gap, showing another preferred embodiment of a fiber opening and feeding arrangement for open end friction spinning;

FIG. 7 is a cross-sectional view similar to FIG. 1, showing yet another preferred embodiment of the invention.

DETAILED DESCRIPTION OF THE DRAWINGS

Figure 3:
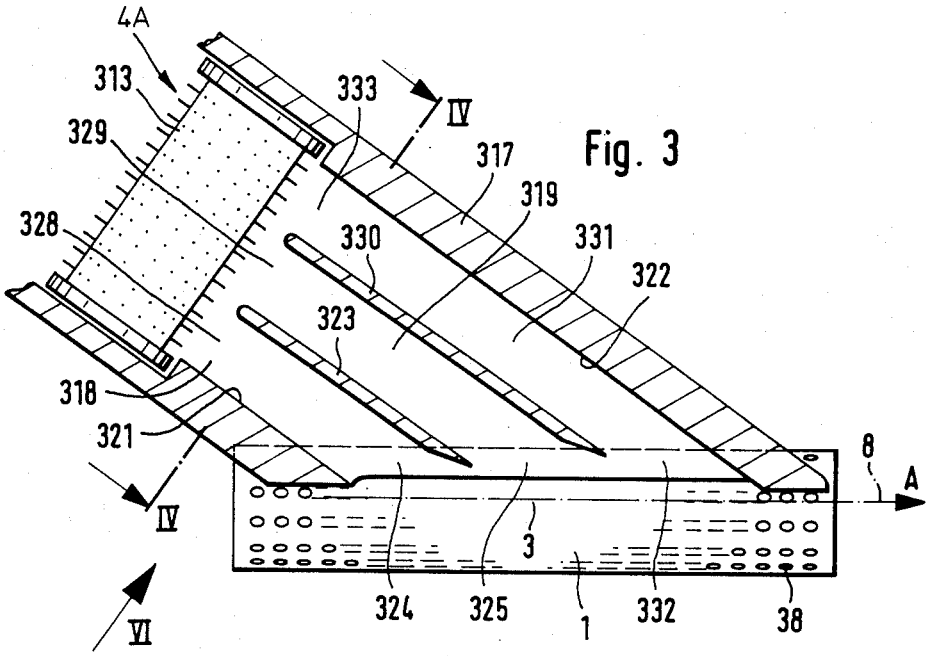
FIG. 3 is a cross-sectional view similar to FIG. 1, showing another embodiment of the invention.

The arrangement for open end friction spinning shown only in part in FIG. 1 includes two parallel and adjacently arranged friction rollers 1 and 2 (of which only roller 1 is shown) which form together a wedge shaped yarn forming gap 3. The two rollers 1 and 2 are driven in the same rotational direction in a manner that is not further described, for example by means of a tangential belt drivingly engaging against their cover surfaces. The two rollers 1 and 2 are constructed as so-called suction rollers with their cover surfaces having perforations 38. Suction inserts are arranged inside the cover surfaces and are connected to a negative pressure (compared to ambient atmospheric pressure) source. The suction inserts are directed via a gap or slot opening from the inside of the rollers 1 and 2 toward the area of the yarn forming gap 3. The suction air streams obtained through the perforations 38 serve on the one hand to retain the forming yarn 8 within the gap 3 and on the other hand to produce a transportation air stream in a fiber feed channel.

The fiber feed channel connects an opening device 4 with the region of yarn forming gap 3.

The opening device 4 is so constructed as to allow the simultaneous and adjacently arranged supply of two fiber bands 5 and 6 and to open the same into single fibers 20. The single fibers 20 are collected in the yarn forming gap 3 and are spun into a yarn 8 which is drawn off in the longitudinal direction of the wedge gap 3 by means of a yarn withdrawal roller pair 7 in direction A. In the illustrated arrangement, the direction of the fiber feed channel extends at a sharp angle to the yarn withdrawal direction A and the fed in fibers 20 have a motion component in the yarn withdrawal direction A. Embodiments are, however, also contemplated with a reversal of the yarn withdrawal direction A, i.e., the yarn withdrawal roller pair is arranged on the opposite facing side of rollers 1 and 2 so that the yarn 8 being produced is withdrawn against the feed in direction of the single fibers.

The opening device 4 includes respective feeding hoppers 11 and 12 for each fiber band 5 and 6, which guide the fiber band to a clamping location between an inlet roller 9 and an inlet table 10. The inlet roller 9 is designed as a cylinder extending in the longitudinal direction of the machine (the complete machine including a plurality of commonly driven, adjacently arranged, spinning units) and has a profiled thickening in the area of the opening device 4 at the respective spinning units. The actual length of the thickening of inlet roller 9 is so chosen that those fiber bands 5 and 6 are grasped between the inlet roller and the inlet table 10. A common inlet table 10 is provided for both fiber bands 5 and 6. Inlet table 10 has channel-like guides adjusted to the fiber beard, which fiber beard gets thinner after passing the clamping means of the inlet roller and table. The inlet table is biased toward the inlet roller 9 by means of a spring element.

Embodiments are also contemplated, generally similar to the arrangement of FIG. 1 described above, but with two individual inlet tablets provided. One inlet table is then provided for each fiber band 5 and 6 which is respectively biased toward the inlet roller 9 by means of independent spring elements so that the clamping power is independently adjustable respectively for each fiber band 5 and 6. This last mentioned arrangement is preferred if fiber bands 5 and 6 are of different fiber material. Another arrangement is contemplated by the invention, wherein, to obtain different inlet conditions, the inlet roller 9 in the area of respectively one of the fiber bands 5 and 6 consists of a different diameter so that different inlet speeds are possible. Embodiments are also contemplated with a single independently driven inlet roller arranged for each fiber band.

Fiber bands 5 and 6 are offered via inlet roller 9 and inlet table 10 in the form of fiber beards to an essentially faster rotating opening roller 13 which combs the single fibers out of the fiber beards, thereby leading to an isolation of fibers 20. The opening roller 13 is designed to be long enough to allow the simultaneous combing out of both fiber bands 5 and 6. For each of the fiber bands 5 and 6, respective individual zones 14 and 15 are provided on the opening roller 13, which zones 14 and 15 are separated from each other by means of a ring band 16 of the opening roller 13. It is thereby possible with this arrangement to provide different combing surface settings or fixtures, i.e., needles or teeth, in the area of zones 14 and 15 so that different combing effects are obtained. Such arrangement is especially preferred if fiber bands 5 and 6 consisting of different fiber material are being processed.

The fiber feed channel is arranged within a housing element 17 and extends essentially in the plane of the yarn forming gap 3 (the plane extending perpendicular to the plane through the axes of rollers 1 and 2 in the middle of the gap). Opening roller 13 is so arranged that its rotating axis extends parallel to this yarn forming gap plane.

In order to orderly transport the greater fiber amount via the fiber feed channel which is enlarged to correspond to the working width of opening roller 13, the fiber feed channel is divided into two sections 18 and 19 which each extend with an individual mouth 24 and 25 into the area of gap 3. The separation of the fiber feed channel into sections 18 and 19 is effected by means of a partitioning wall 23 which extends radially to the opening roller 13 and is disposed in the plane of ring band 16. Sections 18 and 19 of the fiber feed channel are limited by walls 21 and 22 of the housing elements 17 and have a groove-like rectangular cross-section, the longer side of which extends in the cross-section axial direction of the opening roller 13.

By providing for the partitioning wall 23, the altogether rather large fiber feed channel is divided into single channels or sections 18 and 19 in which the air stream is more easily controllable and governed, making a controlled fiber transport possible. The shapes of sections 18 and 19 as well as the area of their mouths 24 and 25 are only schematically illustrated in FIG. 1. One can choose special constructions which influence fiber deposition according to the present invention. It is, however, important that the fibers 20 to be supplied are inserted via the partitioning into sections 18 and 19 in such a manner as to be evenly distributed in the gap 3, and that practically not all fibers that are supplied are deposited at a specific predetermined location. On the contrary, it is provided that the intake of fibers occurs either over the entire length of mouths 24 and 25 evenly or with a desired divergency. According to the chosen yarn withdrawal direction A depicted in FIG. 1, the fibers supplied via mouth 24 are more distant to the draw off roller pair 7 and thus from the center of the core of the yarn. Fibers 20 on the other hand that are supplied via mouth 25 are closer to draw off roller pair 7 and form to a greater extend the outer mantle or cover of the yarn.

By simultaneously supplying two fiber bands 5 and 6, not only the fiber amount and thereby the delivery speed are increased, but also a more consistent yarn 8 is being produced. These advantages are due to the fact that, on the one hand, fibers 20 are supplied at different locations and, on the other hand, any existing irregularities within the fiber bands 5 and 6 are corrected by means of supplying the second fiber band.

Embodiments are also certainly contemplated with the supply of more than two fiber bands 5 and 6 simultaneously and to correspondingly construct the opening device 4 and fiber feed channel to accommodate the number of fiber bands. These arrangements would further improve the yarn quality effects by simultaneously providing precise controlled opening of the fiber bands.

Further embodiments are contemplated by the invention with the separating of the fiber feed channel into sections 18 and 19 to provide different transport speeds for fibers 20 within these sections 18 and 19. For example, the suction inserts arranged within rollers 1 and 2 can be sized with respect to their suction slots or grooves so as to allow a greater suction effect with one of the two sections 18 or 19 and thereby effecting a faster transportation airstream.

The mouths 24 and 25 of sections 18 and 19 are not necessarily one behind each other with their respective entire length in the direction of wedge gap 3 in all contemplated embodiments. It is also contemplated to arrange mouths 24 and 25 in such a manner that their projections overlap at least in the area of gap 3. It is further contemplated to vertically position sections 18 and 19 toward gap 3 so that the mouths partially overlap in the direction of gap 3, according to other cntemplated embodiments of the invention.

With the embodiment according to FIG. 2, the opening roller 13 has zones 14 and 15 separated from each other by means of a ring band 16 and is arranged in such a manner that its rotational axis extends perpendicularly to the longitudinal direction of gap 3. A housing element 217 connects to opening roller 13 and includes a fiber feed channel divided in two sections 218 and 219. There the separation of the feed channel is accomplished by means of a partitioning wall 223 starting in a radial plane to the opening roller 13 and extending with a minor slope to gap 3, so that mouth 224 formed by said partitioning wall 223 with wall 221 is centered above the gap 3. Mouth 225 of section 219 formed by partitioning wall 223 and a channel wall 222 arranged on the opposite side, partially overlaps mouth 224. Mouth 225 is offset against wedge slot 3 by a distance a. The dislocating or offsetting occurs in such a manner that mouth 225 is directed towards the cover surface of the roller 1 which is driven such that it rotates into gap 3 and correspondingly transports the supplied fibers into the gap 3. The suction slots or grooves, especially those of the suction insert of roller 1, are so designed as to produce a transportation air stream in section 219 in the area of mouth 225 and further are effective for holding the fibers at the roller cover surfaces.

Also with this embodiment of FIG. 2 the starting areas 228 and 229 of sections 218 and 219 have a rectangular cross-section of which the longer sides are directed in axial direction to the opening roller 13. The beginning of partitioning wall 223 is opposite the ring band 16 of opening roller 13 also with this embodiment.

In the embodiment according to FIG. 3 an opening roller 313 of opening device 4A is shown whereby its enlarged operational width is not divided so that instead of several fiber bands a single very broad fiber band is being supplied. A housing element 317 connects to the opening roller 313, the axis of said roller 313 extending parallel to the plane of the gap 3. Housing element 317 forms the fiber feed channel which connects the opening roller 313 with gap 3. With this embodiment the fiber feed channel is divided into three sections 318, 319, and 331, by means of two partitioning walls 323 and 330. Partitioning walls 323 and 330 first begin at a spacing from the circumference of opening roller 313 so that the beginning portions 328, 329 and 333 of the fiber feed channel are open. The entire operational width of opening roller 313 is thereby utilized for opening fiber bands. Thereby not only one but, for example, two or three or even four fiber bands are opened simultaneously by the opening roller 313. The air streams and thereby also the fiber streams leading to gap 3 are divided into sections 318, 319, and 331 by means of partitioning walls 323 and 330.

Figure 4:
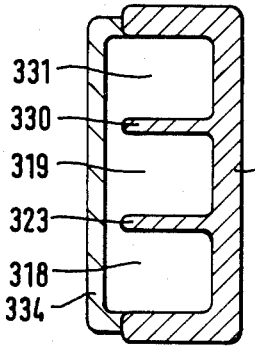
FIG. 4 is a cross-section view along the line IV—IV of FIG. 3.
Figure 6:
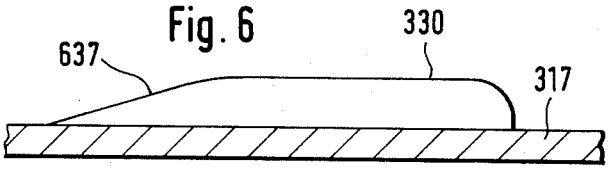
FIG. 6 is a partial sectional view through the fiber feed channel of FIG. 3 in longitudinal direction.

Housing element 317 (FIG. 4) with the embodiment according to FIG. 3 is integrally provided with partitioning walls 323 and 330 which protrude from one side wall. The opposite wall is formed by a cver-like element 334 which is detachably arranged at the housing element 317 so that sections 318, 319 and 331 can be inspected and if need be, cleaned after removal of the cover-like element 334, exposing same. In order to prevent that fibers entangle at the ends of partitioning walls 323 and 330 facing the opening roller 313, said facing parts of these walls provided with a chamfering means 637 (FIG. 6) and furthermore are designed so that they do not entirely reach the side walls formed by element 334. Fibers that, for example, strike the facing edges of partitioning walls 323 or 330, then slide along the chamfering 637 and reach the gap 3 via the fiber feed channel. The partitioning walls, even if they do not extend in their entire length to the opposite side wall, serve the purpose to stabilize and distribute the air stream and the fiber stream.

Figure 5:
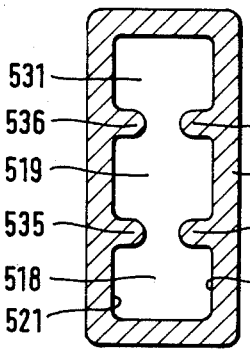
FIG. 5 is a cross-sectional view similar to FIG. 4, showing a fiber feed channel constructed in accordance with another preferred embodiment of the invention.

The fiber feed channel according to FIG. 3 can similarly be constructed corresponding to FIG. 5 as a single unitary one piece housing part 517 including partitioning walls 523', 530', 535, and 536 starting with the opposite side walls 522 and 521, which partitioning walls extend towards each other and allow for a gap in the center. With these partitioning walls it is also possible to distribute and stabilize the air streams and the fiber streams so that sections 518, 519 and 531 are formed having their own respective mouths 324, 325 and 332 as shown and described with respect to FIG. 3, which are disposed one after each other in the draw-off direction A of yarn 8. In order to permit almost stepless passages between the mouth areas 324, 325 and 332, partitioning walls 323' and 330' (of FIG. 5 and corresponding walls of FIG. 5) extend taperingly and are also slightly set back with respect to the gap 3.

The embodiment according to FIG. 7 provides for a broad or wide opening rolling 713 in the opening device 4B, to which is connected housing part 717 containing the fiber feed channel. This fiber feed channel includes two sections 718 and 719 which open with mouths 724 and 725 into yarn forming gap 3 and which are axially positioned one behind the other. Partitioning wall 723 is provided for dividing the fiber feed channel into sections 718 and 719. The beginning of wall 723 is disposed in a radial plane to the opening roller 713 and is spaced therefrom. Therefore the fiber feed channel is not yet divided by means of partitioning wall 723 at the beginning areas 728 and 729 of section 718 and 719. As can be seen from FIG. 7, the formation of partitioning wall 723 also determines the cross-sectional shape of sections 718 and 719. It is for example provided with the embodiment according to FIG. 7 that section 718 is widened in longitudinal direction toward gap 3 between the channel wall 721 and the partitioning wall 723. On the other hand, section 719 between the channel wall 722 and the partitioning wall 723 displays an almost constant cross-section up to the area of the mouth and then first experiences a widening in the area of mouth 725 by means of a convex curving arrangement 739 of channel wall 722. Partitioning wall 723 is tapered knife-like at its end 740 so that mouths 724 and 725 connect almost directly to each other.

Partitioning wall 723 is adjustably arranged in housing part 717 so that the configurations of sections 718 and 719 are adjustable, for example, for fitting a specific fiber material or for other desired spinning conditions. Partitioning wall 723 is adjustable by means of a cross bolt 741 and is accessable with a locking screw 742 in the desired position. It is therefore advantageous to design one of the side walls as a detachable cover in order to get access to locking screw 742.

With the embodiment according to FIG. 7 two or more fiber bands are simultaneously and adjacently supplied to opening roller 713 of opening device 4B. The combed fibers are then distributed according to the positioning of partitioning wall 723 with respect to sections 718 and 719. Embodiments are also here contemplated wherein, instead of feeding several fiber bands, to feed only a single fiber band which corresponds in its width to the widened operational area of opening roller 713.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open end friction spinning comprising:

a pair of friction rollers rotatably drivable in the same direction and arranged adjacent one another to form a yarn forming wedge shape gap therebetween, opening device means for opening fiber band means into individual fibers, fiber feed channel means leading from the opening device means to fiber feed channel mouth means opening toward the yarn forming gap, and yarn withdrawal means for withdrawing yarn in the longitudinal direction of the yarn forming gap, wherein, said opening device means includes opening roller means having at least one opening roller for simultaneously opening a plurality of separate fiber bands making up the fiber band means and wherein the fiber feed channel means is divided in cross-section into plurality of sections having respective channel mouth section means opening into respective different locations in the longitudinal direction of the yarn forming gap.

2. Apparatus according to claim 1, wherein the opening roller means includes an opening roller with an axial length accommodating supply thereto of at least two fiber bands adjacent to and separate from one another and wherein the respective section means of the fiber feed channel means extend from adjacent the opening roller to accommodate separate feeding of the fibers from the opening roller to the yarn forming gap.

3. Apparatus according to claim 1, wherein the opening device means includes an inlet roller configured to allow simultaneous and adjacent feeding of a plurality of fiber bands, said inlet roller being arranged with a common inlet table for all fiber bands.

4. Apparatus according to claim 1, wheren the opening device means includes an inlet roller configured to allow simultaneous and adjacent feeding of a plurality of fiber bands, said inlet roller being arranged with separate inlet tables for each fiber band.

5. Aparatus according to claim 1, wherein individual feeding hopper means for each fiber band are arranged upstream of the opening device means.

6. Apparatus according to claim 1, wherein the fiber feed channel means exhibit a rectangular cross-section configuration at least in its beginning area adjacent opening roller means of the opening device means, said rectangular cross-section having its greater length extending parallel to the axis of the opening roller means.

7. Apparatus according to claim 1, wherein the fiber feed channel means is divided into sections at least by one partitioning wall starting in a radial plane to the opening roller.

8. Apparatus according to claim 7, wherein the at least one partitioning wall extends over only a portion of the cross-section of the fiber feed channel means.

9. Apparatus according to claim 8, wherein the at least one partitioning wall extends from one face wall of the fiber feed channel means closely up to the oppositely facing wall.

10. Apparatus according to claim 9, wherein one of the facing walls of the fiber feed channel means is arranged as a cover-like, detachable element.

11. Apparatus according to claim 1, wherein the at least one partitioning wall tapers knife-like in the fiber feed channel mouth section means area in the direction of fiber transport.

12. Apparatus according to claim 1, wherein the mouths of the sections are vertically staggered to the yarn forming gap whereby one mouth section means is located over the wedge gap while at least one other mouth section means are located opposite the cover surface of the friction roller which rotates into the wedge gap.

13. Apparatus according to claim 1, wherein the at least one partitioning wall are arranged adjustably in position in the fiber feed channel means.

14. Apparatus according to claim 1, wherein the fiber feed channel means is arranged at a sharp angle to the wedge gap.

15. Apparatus according to claim 1, wherein channel sections are adjacently arranged in the plane of the wedge gap.

16. Apparatus according to claim 1, wherein the opening roller is divided into zones for accommodating respectively fiber bands.

17. Apparatus according to claim 16, wherein the opening roller is provided with a ring band between the zones.

18. Apparatus according to claim 1, wherein the opening roller includes zones which are provided with different combing fittings or mountings.

* * * * *